US009334798B2

(12) United States Patent
Pockrandt

(10) Patent No.: US 9,334,798 B2
(45) Date of Patent: May 10, 2016

(54) OIL JET FOR INCREASED EFFICIENCY

(76) Inventor: Scott Clair Pockrandt, Ridgecrest, CA (US)

( * ) Notice: Subject to any disclaimer, the term of this patent is extended or adjusted under 35 U.S.C. 154(b) by 612 days.

(21) Appl. No.: 13/506,123

(22) Filed: Mar. 29, 2012

(65) Prior Publication Data

US 2012/0304632 A1 Dec. 6, 2012

Related U.S. Application Data

(60) Provisional application No. 61/518,458, filed on May 2, 2011.

(51) Int. Cl.
*F01M 1/08* (2006.01)
*F02B 75/12* (2006.01)

(52) U.S. Cl.
CPC . *F02B 75/12* (2013.01); *F01M 1/08* (2013.01)

(58) Field of Classification Search
CPC ..... F02B 75/12; F01M 1/08
USPC ..... 92/140, 159, 186; 123/41.38
See application file for complete search history.

(56) References Cited

U.S. PATENT DOCUMENTS

| | | | | |
|---|---|---|---|---|
| 4,142,484 | A * | 3/1979 | Buhl | 92/159 |
| 4,204,487 | A * | 5/1980 | Jones | 123/41.35 |
| 4,398,507 | A * | 8/1983 | Belsanti | 123/41.38 |
| 4,508,065 | A * | 4/1985 | Suchdev | 92/186 |
| 6,250,275 | B1 * | 6/2001 | Bock et al. | 123/196 R |
| 6,907,848 | B2 * | 6/2005 | Beardmore | 123/41.35 |

* cited by examiner

*Primary Examiner* — Thomas E Lazo

(57) ABSTRACT

The Oil Jet for Increased Efficiency system makes use of internally developed, and stored, oil pressure to direct additional force to assist moving parts in an internal combustion engine, rotating device of any nature, and/or any power producing mechanism, to assist in overcoming frictional, compression, drag, and other resistive forces within said mechanism in order to increase efficiency.

Figure 1:
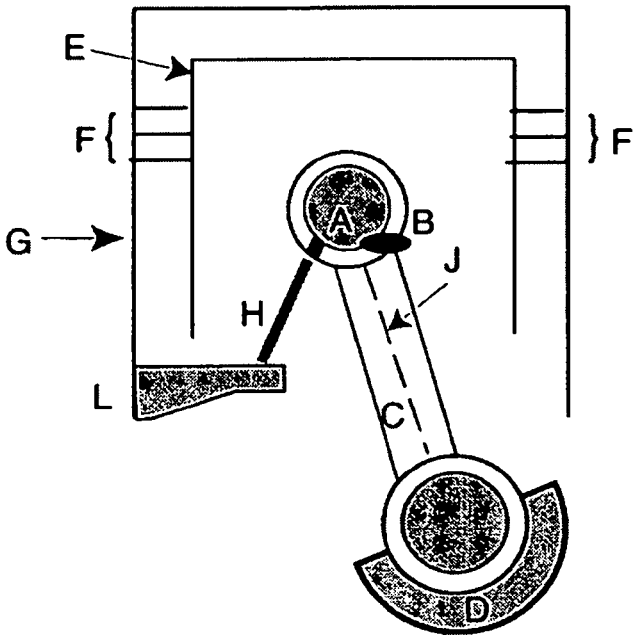
Figure 2:
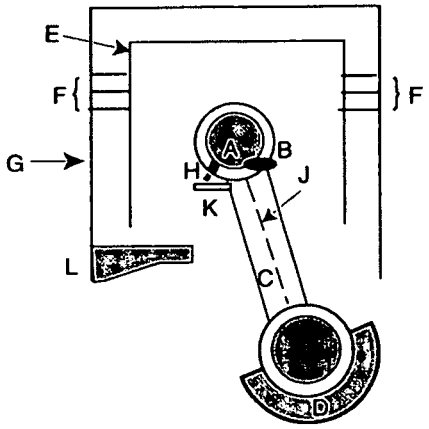
Figure 3:
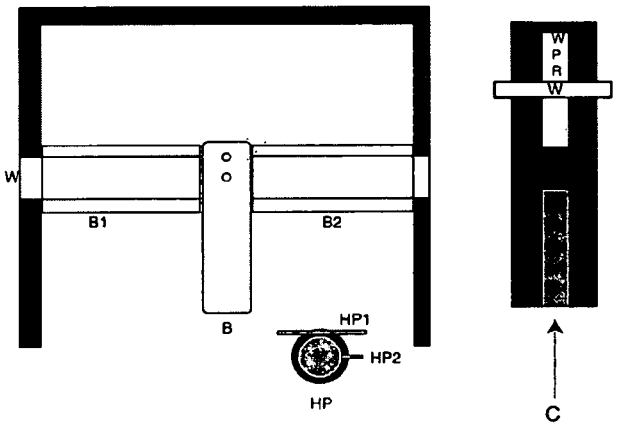
Figure 4:
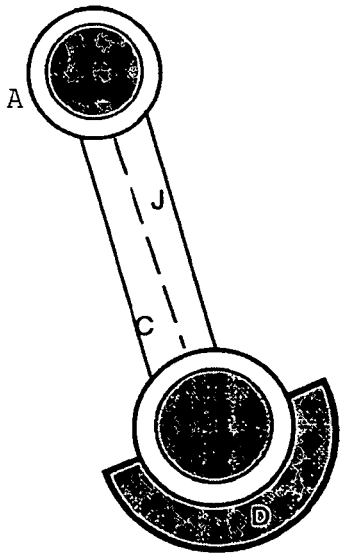
Figure 5:
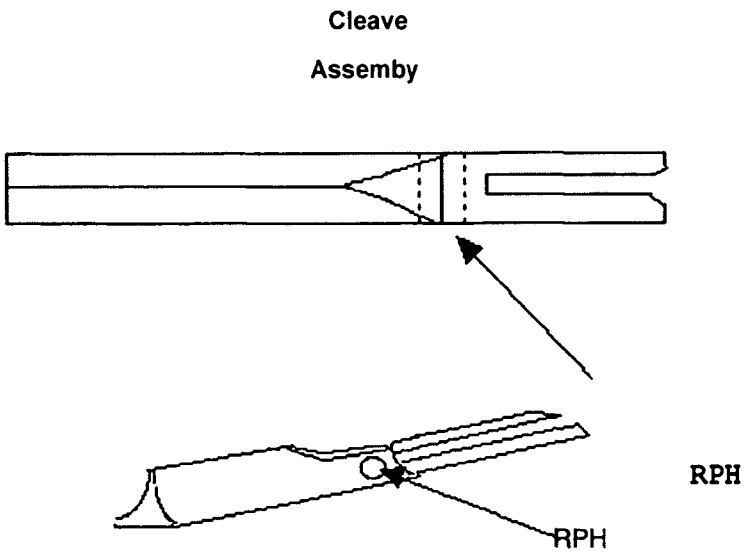
Figure 6:
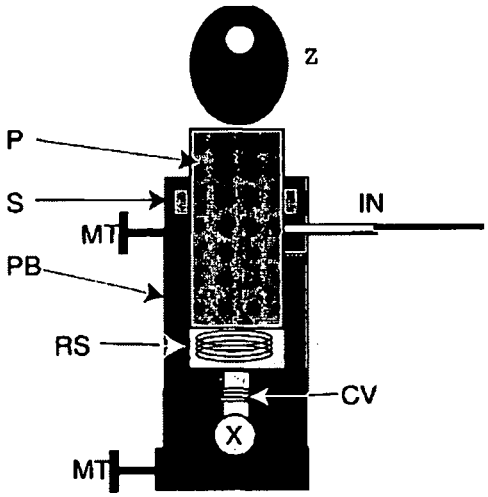
Figure 7:
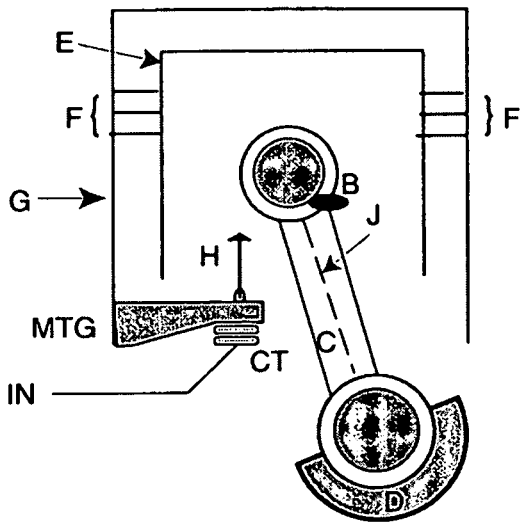
Figure 8:
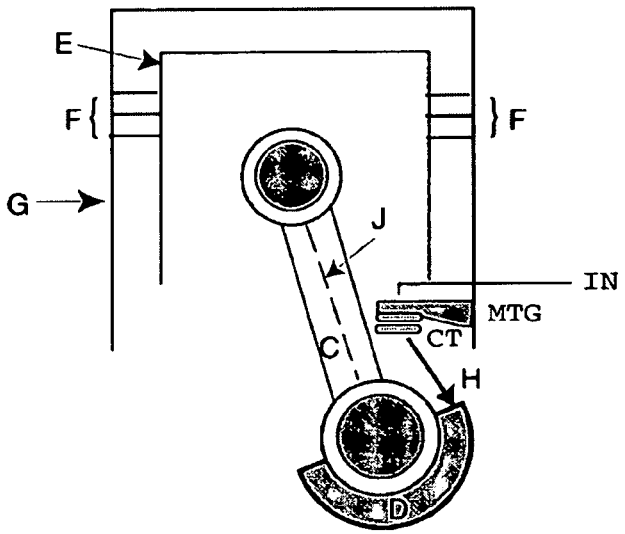
Figure 9:
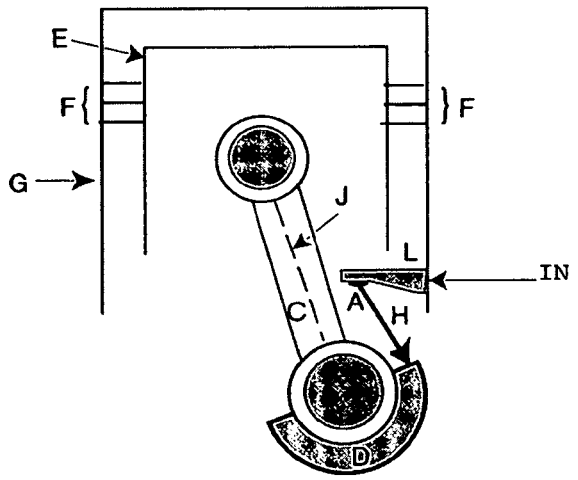
Figure 9A:
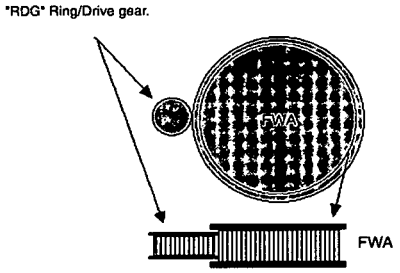

Applications include, but are not limited to, timed application of said oil jet to assist in compression and exhaust strokes. Stead-state and/or timed application to rotating parts, including flywheel, alternator, transmission parts and other rotating parts to provide continuous additional force to assist in overcoming mechanical, frictional and other losses within the system.

4 Claims, 17 Drawing Sheets

Detail of wrist pin and cleave deployment assembly

Cam Pump Assembly

Nominal gear mesh for illustration.

Grooved Crankshaft detail

Stepped Crankshaft detail

Crankshaft can be veined to provide landing for oil jet in steps.

OIL JET FOR INCREASED EFFICIENCY

This application claims priority from Provisional Application No. 61/518,458 filed on May 2, 2011

FEDERALLY SPONSORED RESEARCH

Not applicable.

SEQUENCE LISTING OR PROGRAM

Not applicable.

BACKGROUND

1. Field

This application relates to reduction/elimination of greenhouse gas emissions. Increased efficiency of engines, motors, and all rotational and/or reciprocating power generating devices.

No one else has yet produced a method as described herein to reduce and overcome frictional and other drag losses within.

No previous process or method has been utilized to use the latent and continuous pressure within the power generating and delivery systems described herein, to overcome drag, friction and other mechanical losses, in the manner set forth.

2. Prior Art

As submitted with provisional patent referenced above.

DRAWINGS

FIG. 1:

Oil jet (H) applied to Landing (L) (Landing is attached to engine block, and is immoveable), to provide force assisting piston in overcoming compression resistance in upward motion.

FIG. 2:

Cleave (K) diverts Oil jet (H) during the power and intake strokes.

FIG. 3:

This drawing shows the detail of the Wrist Pin(W) operation, and its connection to the Connecting Rod (C). Although not to scale, the detail shows how the connection is made, and where the knife-edged cleave (K) is deployed, as it is held in the groove of the Connecting Rod (C). The Wrist Pin Lobe (B), not shown in this detail, deploys the Knife-edged cleave (K) at the proper time to divert the Oil Jet (H) from the Landing (L).

FIG. 4:

Shows a very basic drawing of the Connecting Rod (C), Oil Jet Orifice (A), Oil Journal (J) and Crankshaft (D) in isolation from other drawings. Each cylinder has such a support and actuating mechanism, and each is machined to allow the Oil Jet (H) to be delivered by mechanical timing onto Landing (L).

FIG. 5:

Shows elevation drawings for clarity of the knife-edged cleave (K) assembly.

FIG. 6:

Shows a rotating Cam pump assembly. The operation is as follows:

The unit is mounted with an existing or additional cam. Oil is delivered into the Cam Actuated Plunger (P) chamber (encased within the Cam Plunger Bod Unit (PB) when the Plunger (P) is in the raised position by the Return Spring (RS).

An Oil Stop Ring (S) prevents the oil from flowing out of the chamber. Additionally, a one-way Check Valve (CV) is used to prevent loss by back-flow of oil when the Cam Actuated Plunger (P) begins its downward (compression) stroke.

As the cam rotates it depresses the Cam Actuated Plunger (P) driving the oil in the chamber into a manifold distribution system, through a Common Oil Journal (X) for continuously pressurized system.

The pressurized oil is housed in a specially made oil pan made for retrofitting to an existing engine (to be applied by a timed system.

The Cam Actuated Plunger (P) is returned to its original position by action the Return Spring (RS) incorporated into the Cam Actuated Pump Body (PB).

As the cam rotates, the action can be used to apply pulsed oil to the Landing (L.

Optional mountings (MT) are provided for retrofitting to an existing engine.

FIG. 7:

Shows application of Oil Jet (H) timed and directed to the piston (E) during appropriate cycles.

FIG. 8:

Shows application of Oil Jet (H) directed and timed, to the Crankshaft assembly (D) during appropriate times, by a mechanically timed source.

FIG. 9:

Shows application of Oil Jet (H) directed and timed, to the Crankshaft assembly (D) during appropriate times, by a separately timed source.

FIG. 9*a:*

Shows the application of the Oil Jet (H) to the Flywheel (FWA) (or other rotating part of an engine) which can be machined for a working surface for the Oil Jet (H) as shown.

The flow of the Oil Jet (H) can be directed to allow for the additional use as an alternate or additional braking force for the engine, by diversion to apply the Oil Jet to apply to the Flywheel assembly(FWA) in a direction opposing the rotation of the Flywheel assembly.

Figure 10:
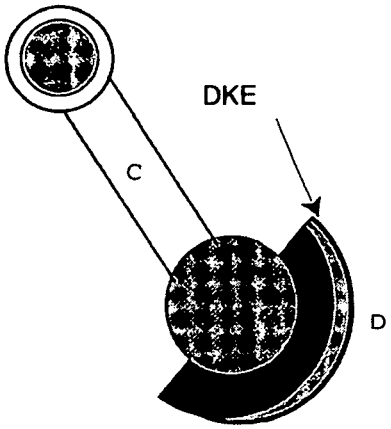
Figure 10:
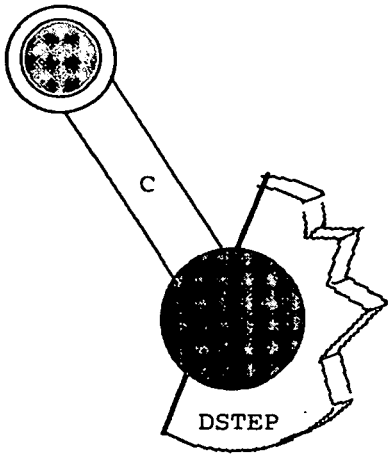
Figure 10A:
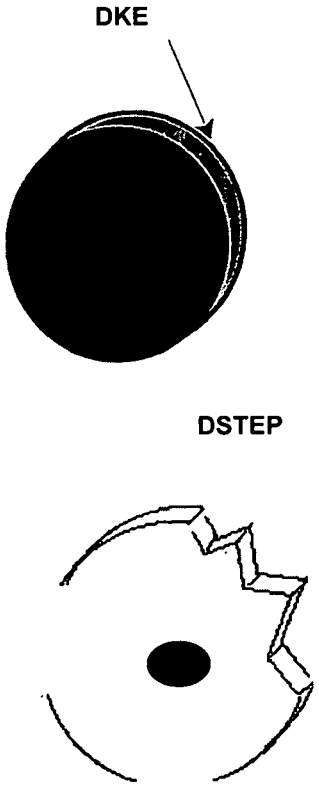
Figure 10B:
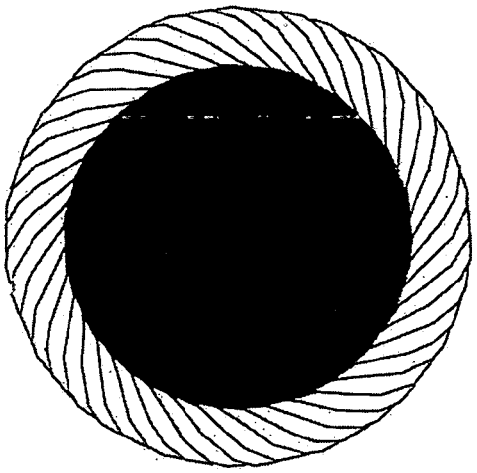
Figure 10C:
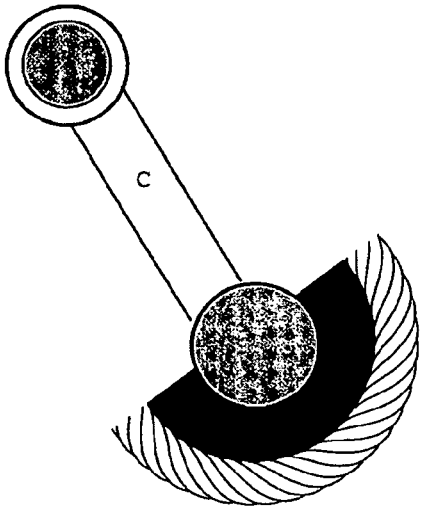
Figure 11:
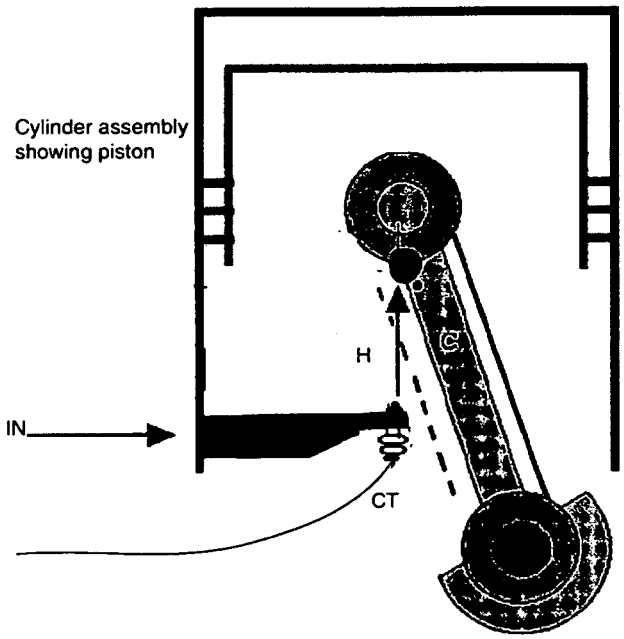
Figure 12:
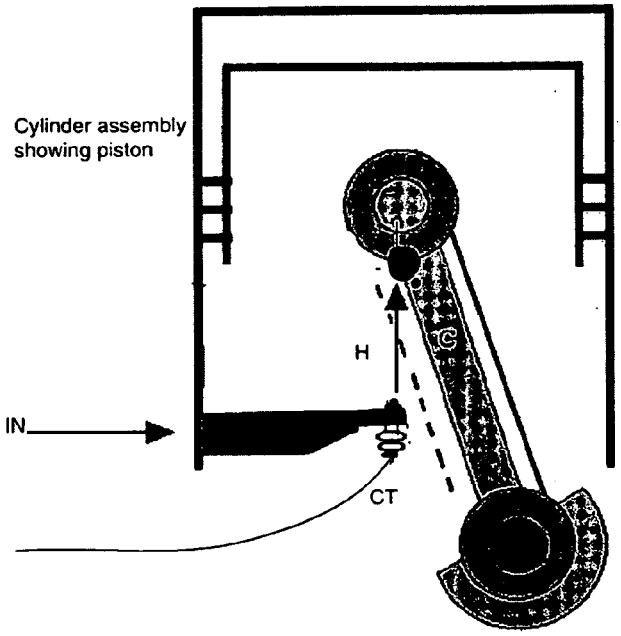
Figure 13:
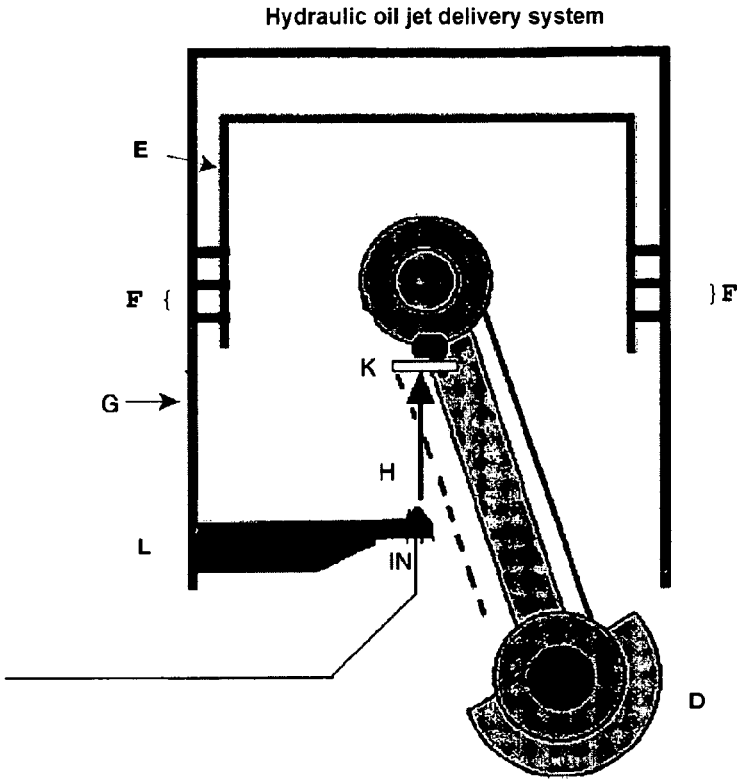

FIG. 10, FIG. 10*a*, FIG. 10*b*, FIG. 10*c:*

Shows the details of modified and machined Crankshaft components, which allow the use of a steady pressure system. These are details of the Crankshaft (D) components which can be made to operate as shown in Drawing 12. The Oil Jet (H) is directed at the Crankshaft(D) in a continuous stream, eliminating the need for timing mechanisms. The shape of the Crankshaft (D), either stepped or tapered-edged controls the amount of force experienced by the Crankshaft (D) as it spins.

FIG. 11:

Shows application of a timed, actuated, system utilizing a static source high/medium/low pressure oil supply.

This application allows for a steady oil pressure, to be applied by a Controlled Port (CT) which releases oil, delivered by the Oil Inlet (IN).

The Landing (L) is converted to use as a mounting for the Controlled Port (CT), and the Knife-edged Cleave (K) is not used in this configuration.

FIG. 12:

Shows application of a timed, actuated, system utilizing a pulsed source high/medium/low pressure oil supply.

This application allows for a pulsed oil pressure, to be applied by the Oil Inlet (IN).

The Landing (L) is converted to use as a mounting for the Oil Injection port(IN), and the Knife-edged Cleave (K) is not used in this configuration.

The Oil Jet (H) is directed in such a manner that the Piston (P) is driven upward during compression and exhaust strokes, thus aiding in overcoming compression and frictional forces in the engine.

FIG. 13:

Shows application of a continuous source of high/medium/low pressure oil supply, to be applied by the Oil Inlet (IN).

The Landing (L) is converted to use as a mounting for the Oil Injection port(IN), and the Knife-edged Cleave (K) is used in this configuration to control the application of force from the Oil Jet.

Drawing 14:

Shows detail of pulsating oil jet. Noting that as distance of stroke increases, efficiency can decrease. Use of pulsating jet allows for greater duration when more distance in encountered, thereby averaging the pressure applied over the entire stoke path. Also shown is addition of diverter cleave, as necessary to provide positive diversion of oil jet when appropriate.

Drawing 15:

Shows direction of oil jet onto crankshaft, or other mounting/driving part.

Drawing 16:

Shows construction, generally, of the knife-edged or stepped shape of crankshaft or other mounting/driving part in Drawing 15.

Details of drawings are included in the drawings themselves, all parts shown indicate use in common internal combustion engine, showing the cylinder, piston, connecting rod (conrod), crankshaft, electrical components and other common parts.

Drawing 7 is exceptional in this respect as it details an internally mounted campump, which utilizes the flywheel inertial energy, coupled with electrical assisting motor, to pressurize a manifold distribution system for maintaining high pressure for use in the oil jet.

The operation uses the application of a high pressure oil jet to assist the "upward" or compressing stroke and the exhaust stroke of an internal combustion engine to aid in overcoming resistance, and frictional forces during this part of the engine operation.

The oil jet is diverted during the power and intake strokes, to allow for free movement.

Oil jet can be utilized to replace "back pressure" to slow vehicle as well during deceleration periods. See Drawing 8, with oil jet reversing effect.

The oil jet is either timed, or diverted mechanically during the proper strokes, and is maintained at a sufficient pressure to be utilized to overcome and/or eliminate power-robbing frictional and compression forces in the engine.

The oil jet can be applied to any rotating device, at any point to assist in overcoming drag or frictional forces, and uses otherwise wasted over-pressure in the system for this purpose.

ALPHABETICAL LISTING OF IDENTIFIERS

A
- A. Oil Jet Orifice

B
- B. Wrist pin lobe
- B1 Left side thin sleeve, wrist pin holder
- B2 Right side thin sleeve, wrist pin holder C
- C. Connecting Rod
- CT Injection unit
- CV One-way check valve D
- D. Crankshaft
- DKE Knife-edged Crankshaft Assm
- DSTEP Stepped Crankshaft Assm
- DV Veined Crankshaft Assm.

E
- E. Piston

F
- F. Piston rings
- FWA Flywheel assembly

G
- G Cylinder

H
- H. Oil jet
- HP. Holding pin assembly
- HP1 is through "hold pin"
- HP2 is set pin, half-through I
- IN Oil in-port
- INP Oil inlet, under pressure J
- J. Oil journal K
- K. Knife-edged cleave L
- L. Landing/Anvil M
- MT Mountings
- MTG Mounting for CT P
- P Cam actuated plunger
- PB Cam plunger body unit
- PRS Oil under pressure for distribution R
- RDG Ring/Drive Gear
- RPH Wristpin hole
- RS Return Spring
- RSI Inside skin of unit
- RSO Outside skin of unit
- STO Oil, storage, not under pressure S
- S Oil stop ring W
- W. Wrist pin
- W Wrist pin
- WPR Wrist pin lobe receiver slot X
- X Common oil journal boss Z
- Z Cam actuator lobe

The invention claimed is:

1. A process and method of reducing frictional losses of an internal combustion engine, rotating engine, power producing device, comprising the steps of:

a. applying a jet of high pressure oil, or other liquid, to the piston assembly, and;

b. directing said oil jet to a landing attached to the cylinder wall and immoveable, and;

c. using the pressure of said oil jet to assist in the movement of the piston, or other structure, in such a manner as to assist in overcoming frictional, compression drag forces within said power producing device.

2. A process and method of reducing frictional losses of an internal combustion engine, rotating engine, power producing device, as in claim 1, further comprising the steps of:

a. applying waste energy from the internal combustion engine, rotating engine, power producing device to a pump;

b. using the pump to pressurize an accumulator, manifold or other storage and distribution assembly, and;

c. supplying pressure from the accumulator, manifold or other storage and distribution assembly to the jet of high pressure oil.

3. A process and method of reducing frictional losses of an internal combustion engine, rotating engine, power producing device, comprising the steps of:

a. applying a jet of high pressure oil, or other liquid, wherein the pressure is applied to the piston assembly, and;

b. directing said oil jet to a divet attached to the cylinder wall and immoveable, and;

c. using the pressure of said oil jet to assist in the movement of the piston, or other structure, in such a manner as to assist in overcoming frictional, compression drag forces within said power producing device.

4. A process and method of reducing frictional losses of an internal combustion engine, rotating engine, power producing device, comprising the steps of:

a. applying a jet of high pressure oil, or other liquid, wherein the pressure is applied to the piston assembly, and;

b. directing said oil jet to a landing attached to the cylinder wall and immoveable, and;

c. using a cleave assembly to apply the pressure of said oil jet, with appropriate timing, to assist in the movement of the piston, or other structure, in such a manner as to assist in overcoming frictional, compression drag forces within said power producing device.

* * * * *